US006720669B1

(12) United States Patent
Chiappe et al.

(10) Patent No.: US 6,720,669 B1
(45) Date of Patent: Apr. 13, 2004

(54) STARTER FOR AIRCRAFT PISTON ENGINES

(76) Inventors: Eugene Chiappe, 9015 Woodlawn, Granbury, TX (US) 76049; Leven Edward Staples, 9641 Airpark Dr., Granbury, TX (US) 76049

( * ) Notice: Subject to any disclaimer, the term of this patent is extended or adjusted under 35 U.S.C. 154(b) by 0 days.

(21) Appl. No.: 10/287,021

(22) Filed: Nov. 4, 2002

(51) Int. Cl.[7] ..... F02N 15/06
(52) U.S. Cl. ..... 290/38 R; 290/48
(58) Field of Search ..... 290/38 R, 48; 310/83; 74/6

(56) References Cited

U.S. PATENT DOCUMENTS 3,782,223 A * 1/1974 Watson ..... 74/665 L
4,924,126 A * 5/1990 Isozumi ..... 310/83
5,023,466 A * 6/1991 Isozumi ..... 290/48
5,163,335 A * 11/1992 Isom et al. ..... 74/6
D360,638 S 7/1995 Williams
5,760,487 A * 6/1998 Kimura et al. ..... 290/48
5,844,336 A * 12/1998 Ohya et al. ..... 310/80
5,877,575 A * 3/1999 Nara et al. ..... 310/239
5,901,604 A * 5/1999 Sato et al. ..... 74/7 A
6,268,670 B1 * 7/2001 Kuragaki et al. ..... 310/75 R

FOREIGN PATENT DOCUMENTS

EP 867612 A1 * 9/1998 ..... F02N/15/06
EP 878895 A1 * 11/1998 ..... H02K/7/10
JP 07259709 A * 10/1995 ..... F02N/11/00

* cited by examiner

*Primary Examiner*—Joseph Waks

(57) ABSTRACT

A starter for a piston aircraft engine is constructed by placing the pinion-gear and drive clutch, the engagement solenoid and the driving motor in a linear arrangement, the motor driving the clutch via a geared shaft passing by the engagement solenoid. Such construction provides minimum diameter for a solenoid-engaged piston aircraft engine starter in order to fit the available space on existing aircraft originally designed to be equipped with centrifugally-engaged starters.

2 Claims, 3 Drawing Sheets

I–I

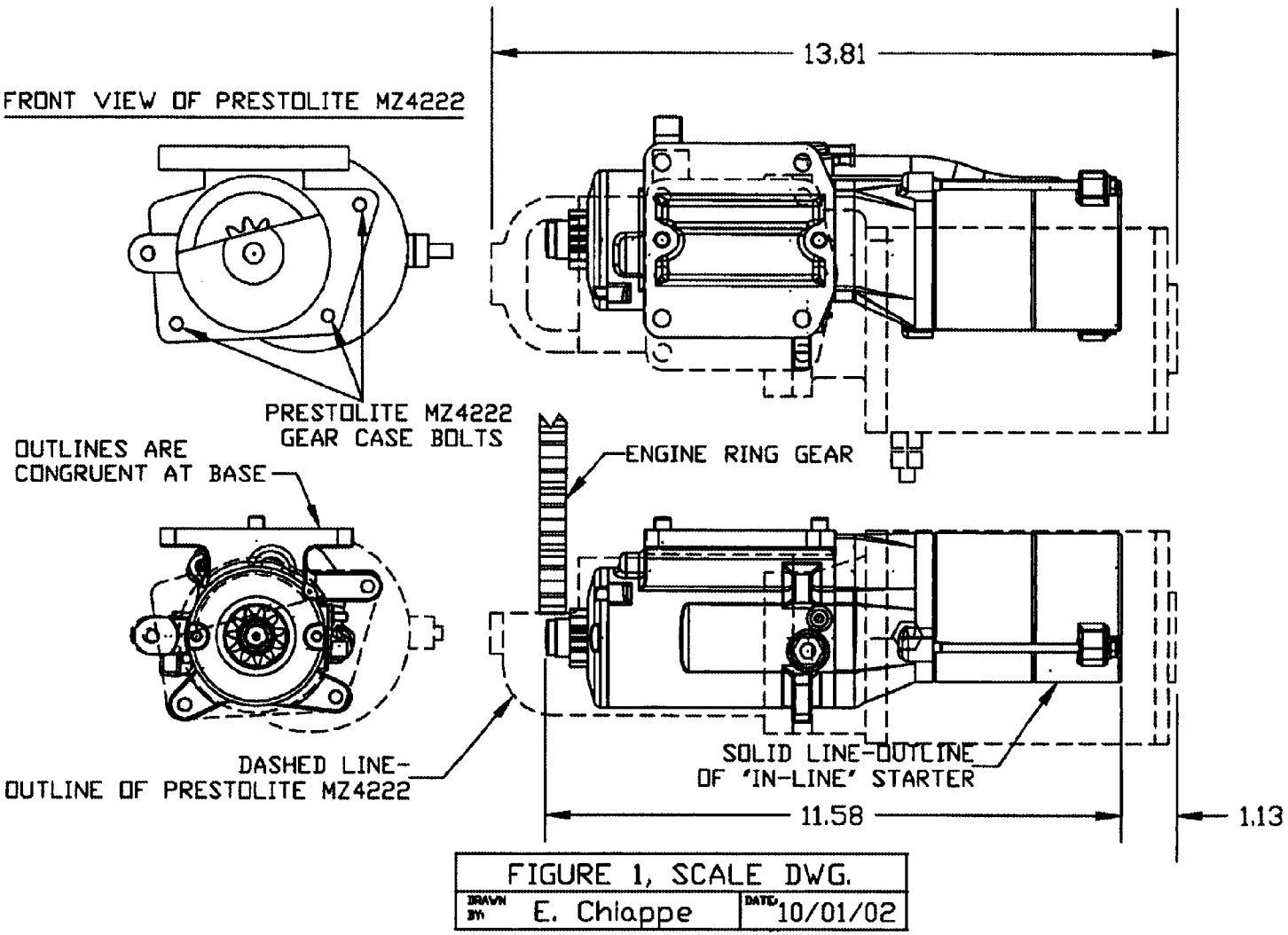
13.81
1.13
11.58
ENGINE RING GEAR
SOLID LINE-OUTLINE OF 'IN-LINE' STARTER
FRONT VIEW OF PRESTOLITE MZ4222
PRESTOLITE MZ4222 GEAR CASE BOLTS
OUTLINES ARE CONGRUENT AT BASE
DASHED LINE-OUTLINE OF PRESTOLITE MZ4222
FIGURE 1, SCALE DWG.
DRAWN BY E. Chiappe
DATE 10/01/02

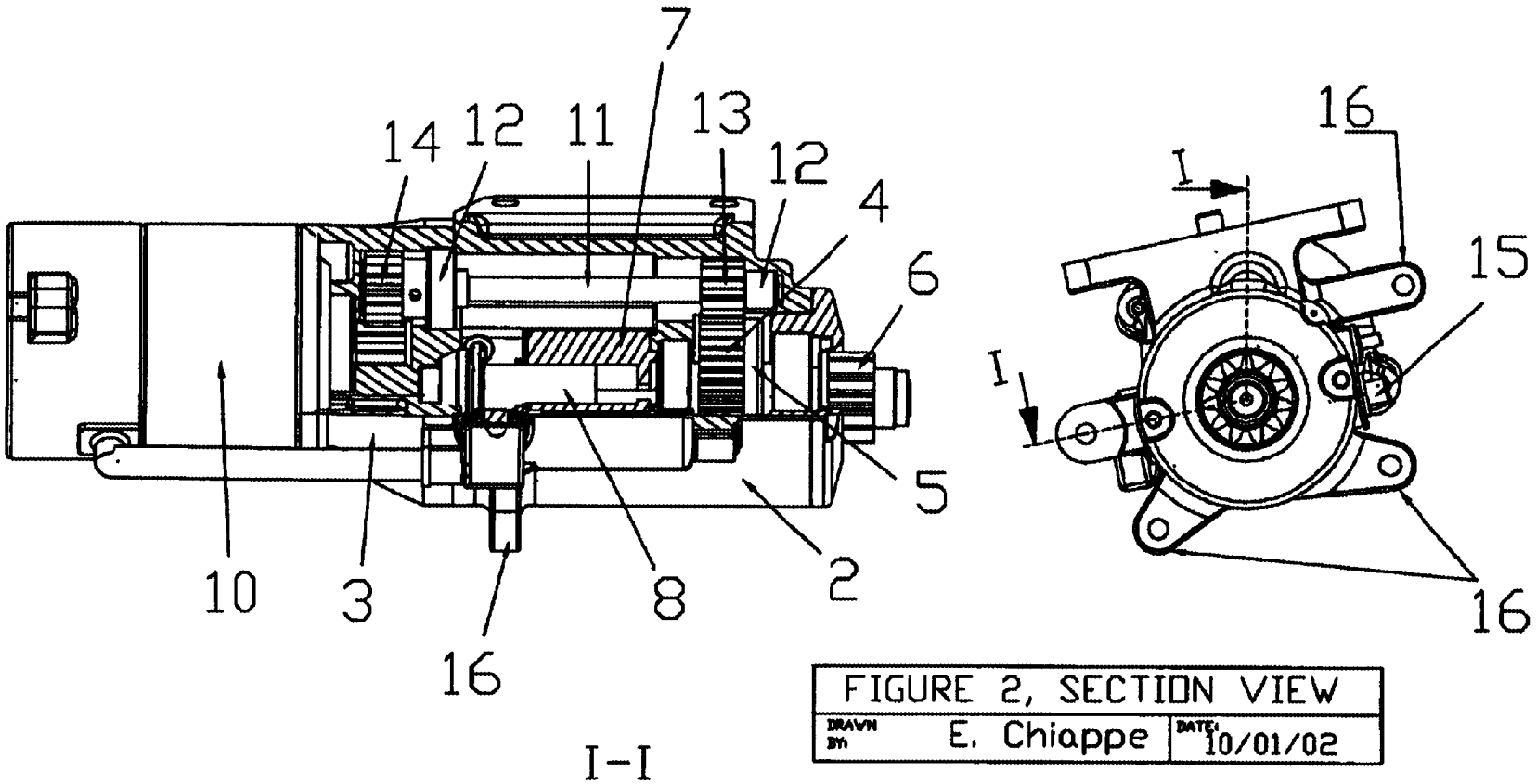
15
16
16
I
I
6
5
4
2
12
13
7
8
11
12
16
14
3
10
I-I
FIGURE 2, SECTION VIEW
DRAWN BY: E. Chiappe
DATE: 10/01/02

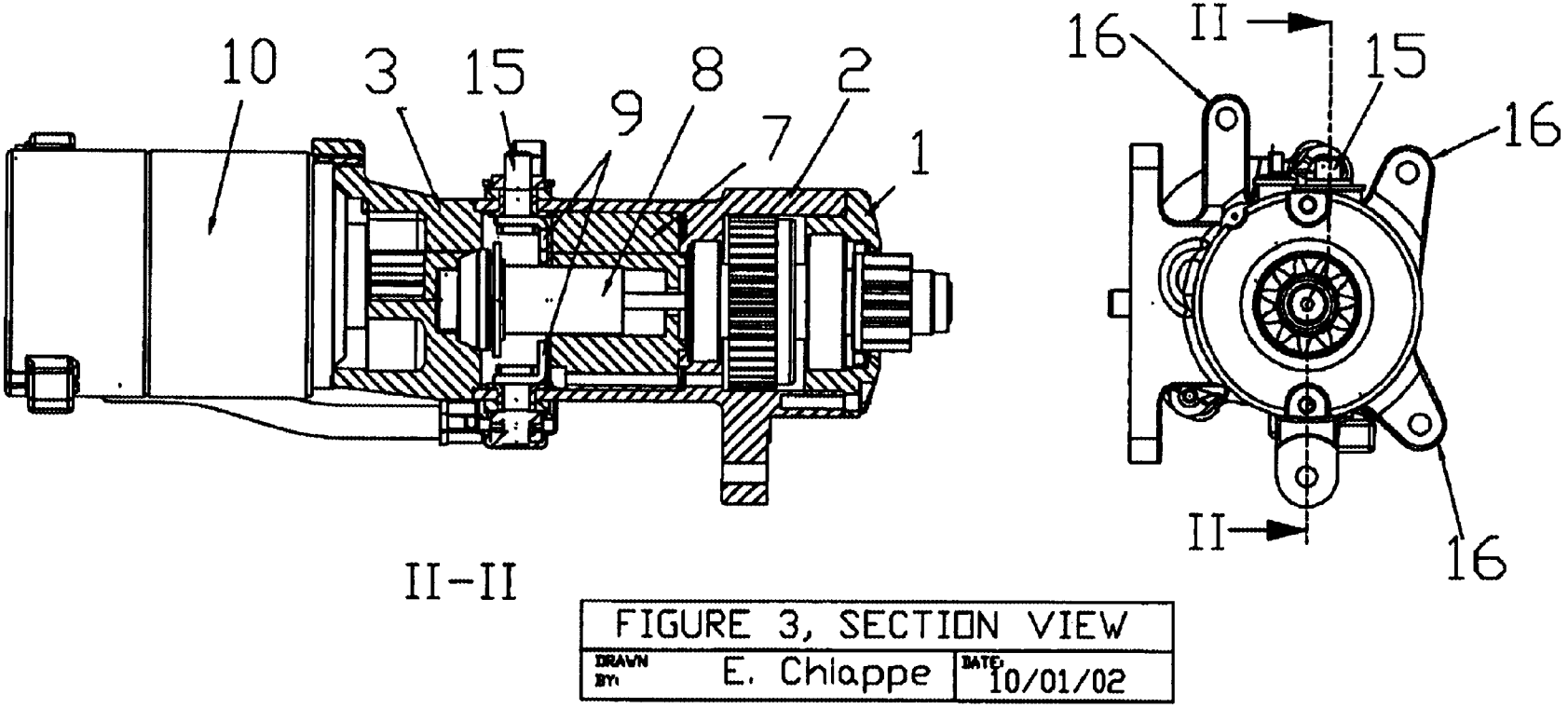
16
16
15
II
II
16
1
2
7
8
9
15
3
10
II-II
FIGURE 3, SECTION VIEW
DRAWN BY
E. Chiappe
DATE
10/01/02

STARTER FOR AIRCRAFT PISTON ENGINES

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to starters (cranking motors) for piston aircraft engines equipped with ring-gears driven by the starter. Original equipment starters incorporated centrifugal engagement of the starter pinion gear with the engine ring-gear. This engagement method, referred to as "Bendix drive" systems, were used on automobiles in the period of 1930–1950 and were replaced by solenoid engagement in that application due to the inherent unreliability of the centrifugal engagement system. A starter similar to this invention is known from U.S. Pat. No. Des. 360,638 (Sky-Tec) which utilized a solenoid engagement mechanism in conjunction with a DC motor and gear-reduction unit. The starter identified in U.S. Pat. No. Des. 360,638 provided greater reliability but only fits engines in aircraft that can accommodate a starter width dictated by sum of the diameters of the solenoid engagement mechanism and that of the DC motor located side-by-side. This diameter is too large to fit the available space in many existing aircraft designs.

BRIEF SUMMARY OF THE INVENTION

It is, therefore, an objective of this invention to overcome the disadvantages of the previous art through realignment of the major components to provide a starter with a diameter no wider than that of any previous art while increasing reliability over earlier, centrifugally engaged, starters.

The original equipment starters fitted to the subject aircraft engines, notably those engines produced by Lycoming, utilized centrifugal engagement mechanism (Bendix-drives) located on the shaft of a DC motor or driven by such a motor through an offset gearing arrangement. This prior art has been insufficient in reliability and many attempts have been made to replace the centrifugal engagement mechanism with more reliable solenoid engagement. All of these attempts have fallen short of the goal of being suitable to replace all of the original equipment starters, as many aircraft installations were designed in such a manner that no starters wider than the original will fit in the space allocated.

To obtain the objective of increased reliability without increase in diameter or size in any other dimension, a novel construction has been employed in the starter that is the subject of this invention: A pinion gear and one-way clutch assembly is located at the front of the starter. Immediately behind this assembly is an electromechanical solenoid containing a plunger which pushes the pinion forward to engage the engine's ring-gear. Finally, a DC motor is located behind the solenoid and drives the clutch & pinion assembly via a gear-shaft that passes by the solenoid.

This novel construction, hereinafter called the, "in-Line" starter, results in a starter that incorporates the reliability of solenoid engagement with the small diameter of earlier, centrifugally engaged, starters.

BRIEF DESCRIPTION OF THE DRAWINGS:

FIG. 1 is a scale drawing of the "In-Line" starter that is the subject of this patent and, to the same scale, an original equipment starter (Prestolite Model MZ4222) with -the two outlines superimposed.

FIGS. 2 and 3 are section-views of the "In-Line" starter that is the subject of this patent with the major components identified.

DETAILED DESCRIPTION OF THE INVENTION

Starter Fit

As can be seen from FIG. 1, the "In-Line" starter that is the subject if this invention (1) fits within the outline of the centrifugally-engaged original equipment starter (2) and mounts in the same manner to the engine. This allows an "In-Line" starter to be substituted in any aircraft application that used the original equipment starter shown without modification to the aircraft.

Construction

The "In-Line" Starter shown in FIGS. 2 and 3 is comprised of a three-piece housing; the Nose Piece (1), the Mount/Solenoid Housing (2), and the Motor Adapter (3). A Drive Assembly (4) containing a one-way clutch (5) and a pinion gear (6) is housed in the Mount/Solenoid Housing (2). An electromechanical Solenoid Assembly containing pull and hold coils (7) a plunger assembly (8) and switching contacts (9) are also housed in the Solenoid Housing (2). A DC motor (10) is joined to the Solenoid Housing (2) by bolts into the Motor Adapter (3). A single drive-shaft (11) couples the DC Motor (10) to the drive assembly (4) via gears (13 & 14) located on the drive-shaft.

The drive-shaft (11) is supported by two bearings (12), one located in the Mount/Solenoid Housing (2) and the other in the Motor Adapter (3). In order to provide proper engine cranking speed and torque, the gears (13 & 14) on the drive-shaft (11) are chosen to provide a calculated gear-reduction between the armature of the Motor (10) and the drive assembly (4). In this embodiment of the "In-Line" starter, one of the gears (14) is coupled to the drive-shaft (I1) by a safety shear means in case of an engine misfire which could cause serious damage to the starter.

Operation

When electric power is applied to the power terminal (15), current flows through the solenoid pull and hold coils (7) causing the plunger assembly (8) to move forward by electromagnetic force, pushing the pinion-gear (6) forward to engage the engine ring-gear and electrically connecting the contacts (9) in the solenoid assembly. When the contacts (9) are electrically connected, power is thereby applied to the Motor (10), causing its armature to turn. When the armature of the DC Motor (10) turns, it turns the drive-shaft (11) via the gear (14). The drive-shaft (11) turns the drive assembly via the gear (13), thereby turning the pinion-gear (6) via the one-way clutch (5). Electrically connecting the contacts also shorts the pull-coil (part of (7)), leaving the hold-coil (part of (7)) to maintain, via electromagnetic force, the position of the solenoid plunger. Maintaining the position of the plunger assembly (8) by current only through the hold-coil reduces the power requirement of the coils (7) while power is applied to the motor.

When electric power is removed from the power terminal (15), the electromagnetic field of the coils (7) collapses and the plunger assembly (8) is moved back by a spring. This action causes the pinion-gear (6) to move back by spring action, disengaging it from the engine ring gear.

We claim:

1. A starter (cranking motor) intended for the cranking of an aircraft piston engine equipped with a ring-gear for such purpose, said starter incorporating (a) a pinion-gear driven by a one-way clutch drive assembly, (b) an electromechanical engagement solenoid containing a plunger which pushes said pinion-gear into engagement with said engine's ring-gear without intervention of any lever-arm, (c) a DC motor which drives said pinion-gear via said one-way clutch drive assembly through (d) a geared shaft that provides gear reduction between the armature of said motor and said one-way clutch drive assembly, said electromechanical engagement solenoid located between said one-way clutch mechanism and said motor, said geared shaft passing by said solenoid.

2. The starter of claim 1 which incorporates drilled bosses for the attachment of brackets and accessories, such bosses located in the same or similar position as the gear-case bolts of the Prestolite MZ4222 starter that it replaces.

* * * * *